US007699524B2

(12) United States Patent
Moore, Sr.

(10) Patent No.: US 7,699,524 B2
(45) Date of Patent: Apr. 20, 2010

(54) UTILITY BAG FOR PROMOTIONAL MATERIALS

(76) Inventor: Joseph L. Moore, Sr., 19118 Longbrook Rd., Warrensville Heights, OH (US) 44128

( * ) Notice: Subject to any disclaimer, the term of this patent is extended or adjusted under 35 U.S.C. 154(b) by 1023 days.

(21) Appl. No.: 11/404,710

(22) Filed: Apr. 13, 2006

(65) Prior Publication Data

US 2006/0233465 A1 Oct. 19, 2006

Related U.S. Application Data

(60) Provisional application No. 60/672,163, filed on Apr. 15, 2005.

(51) Int. Cl.

| | |
|---|---|
| ***B65D 33/06*** | (2006.01) |
| ***B65D 30/22*** | (2006.01) |
| ***A45C 1/02*** | (2006.01) |
| ***A45C 3/00*** | (2006.01) |

(52) U.S. Cl. ..... 383/13; 383/38; 383/40; 150/112; 150/117; 190/109; 190/111

(58) Field of Classification Search ..... 383/40, 383/13, 105, 38; 150/112, 117, 119, 107, 150/108; 190/109, 111, 900, 902, 903, 115, 190/116

See application file for complete search history.

(56) References Cited

U.S. PATENT DOCUMENTS

| | | | | | |
|---|---|---|---|---|---|
| 1,370,636 | A | * | 3/1921 | Dwyer | 383/13 |
| RE15,104 | E | * | 5/1921 | Axelman et al. | 190/109 |
| 1,560,442 | A | * | 11/1925 | Trowbridge | 150/112 |
| 1,648,565 | A | * | 11/1927 | Primley | 206/315.9 |
| 1,871,197 | A | * | 8/1932 | Plotkin | 190/109 |
| 1,907,676 | A | * | 5/1933 | Roth | 190/119 |
| 2,103,281 | A | * | 12/1937 | Stanley | 190/109 |
| 2,691,400 | A | * | 10/1954 | Giordano | 190/111 |
| 2,989,998 | A | * | 6/1961 | Harris | 190/108 |
| 3,001,566 | A | * | 9/1961 | Lipsitz | 224/610 |
| 4,086,945 | A | * | 5/1978 | Carter | 206/445 |
| 4,463,848 | A | * | 8/1984 | Parker | 206/214 |
| D282,505 | S | | 2/1986 | Bomes et al. | |
| 4,867,215 | A | | 9/1989 | Macieowitz | |
| 4,989,656 | A | | 2/1991 | Derfler | |
| 5,018,609 | A | * | 5/1991 | Brenner | 190/108 |
| 5,160,001 | A | * | 11/1992 | Marceau | 190/102 |
| 5,161,656 | A | * | 11/1992 | Brenner | 190/111 |
| D347,730 | S | | 6/1994 | McAllister | |
| 5,713,616 | A | * | 2/1998 | Knudson | 294/1.3 |
| 6,179,025 | B1 | | 1/2001 | Sutton | |
| 6,237,776 | B1 | * | 5/2001 | Mogil | 206/579 |
| D446,013 | S | | 8/2001 | Pironti | |
| 6,880,747 | B1 | * | 4/2005 | Pelleg | 229/67.3 |
| 2003/0029762 | A1 | * | 2/2003 | Ho | 206/425 |
| 2004/0149600 | A1 | * | 8/2004 | Wolter et al. | 206/223 |
| 2006/0006097 | A1 | * | 1/2006 | Peacock | 206/828 |
| 2006/0191759 | A1 | * | 8/2006 | Ho | 190/109 |
| 2007/0131568 | A1 | * | 6/2007 | Georgia et al. | 206/223 |

* cited by examiner

*Primary Examiner*—Jes F Pascua
(74) *Attorney, Agent, or Firm*—James Ray & Assoc

(57) ABSTRACT

A utility bag for carrying and distributing a plurality of generally thin promotional sheet materials includes a housing having a generally rectangular parallelepiped shape and including, in combination, a front panel, a rear panel, a pair of sides panels and a bottom panel, wherein the combination forms an internal compartment open at one end, and wherein the internal compartment is sized to receive such plurality of generally thin promotional sheet materials. A handle or flexible strap is connected to the housing for carrying such bag.

1 Claim, 1 Drawing Sheet

UTILITY BAG FOR PROMOTIONAL MATERIALS

CROSS-REFERENCE TO RELATED APPLICATIONS

This application is related to and claims priority from Provisional Patent Application Ser. No. 60/672,163 filed Apr. 15, 2005.

FIELD OF THE INVENTION

The present invention relates, in general, to utility bags and, more particularly, this invention relates to utility bags for carrying and distributing generally thin promotional sheet materials.

BACKGROUND OF THE INVENTION

As is generally well known, promotional information can include advertisement for concerts, political events, notice of public events, store sales and offerings and the like. The promotional information is usually distributed in a form of a generally thin single sheet material, typically measuring 8.5 inches in width and 11.00 inches in height or the size of the standard sheet of paper.

A single sheet may be given to a single member of the public targeted to receive such promotional information or it may be placed in a location for view by a large number of individuals. One of the more common methods for distributing such promotional information is known as a door-to-door method, wherein a person charged with distributing such promotional information must quickly cover large distances, usually on foot, in order to reduce distribution costs.

Furthermore, in some applications, the distributor of the promotional information must leave or present a business card containing his or her identity or containing the identity of the organization associated with the event and it may require the use a writing instrument, for example a pen, to record additional information.

Accordingly, the individual must carry a variety of different articles while covering large distances.

SUMMARY OF THE INVENTION

The invention provides a utility bag for carrying and distributing a plurality of generally thin promotional sheet materials. The bag includes a housing having a generally rectangular parallelepiped shape. The housing includes, in combination, a front panel, a rear panel, a pair of sides panels and a bottom panel. Such combination forms an internal compartment open at one end. The internal compartment is sized to receive such plurality of generally thin promotional sheet materials. A handle or flexible strap is connected to the housing for carrying such bag. An external pocket is formed on the front panel.

OBJECTS OF THE INVENTION

It is, therefore, one of the primary objects of the present invention to provide a utility bag for carrying and distributing generally thin promotional sheet materials.

Another object of the present invention is to provide a utility bag for carrying and distributing generally thin promotional sheet materials that is convenient to handle.

Yet another object of the present invention is to provide a utility bag for carrying and distributing generally thin promotional sheet materials which is economical to manufacture.

A further object of the present invention is to provide a utility bag for carrying and distributing generally thin promotional sheet materials that offers protection to such promotional materials.

Yet a further object of the present invention is to provide a utility bag for carrying and distributing generally thin promotional sheet materials which is capable of storing a plurality of business cards and a writing instrument.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
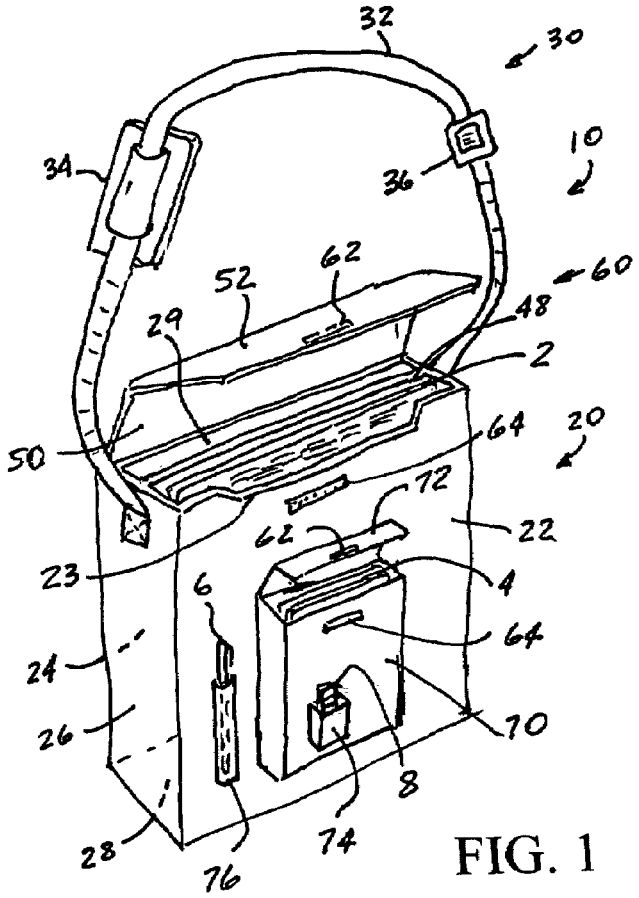
FIG. 1 is a perspective view of the utility bag according to one embodiment of the present invention.

Prior to proceeding to the more detailed description of the present invention, it should be noted that, for the sake of clarity and understanding, identical components which have identical functions have been identified with identical reference numerals throughout the several views illustrated in the drawing figures.

Figure 2:
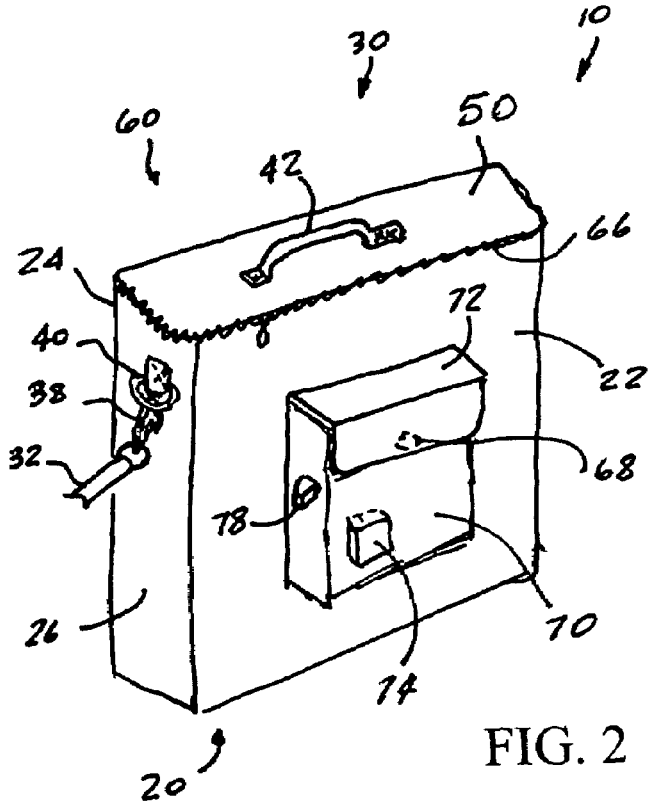
FIG. 2 is a perspective view of the utility bag according to another embodiment of the present invention.

Reference is now made, to FIGS. 1-2, wherein there is shown a utility bag, generally designated 10, for carrying and distributing a plurality of generally thin promotional sheet materials 2. The utility bag 10 includes a housing, generally designated 20, having a generally rectangular parallelepiped shape. The housing 20 includes, in combination, a front panel 22, a rear panel 24, a pair of opposed sides panels 26 and a bottom panel 28. Such combination forms an internal compartment 29 which is open at one end and is sized to receive such plurality of generally thin promotional sheet materials 2. The top edge of the front panel 22 may be provided with a cut-out 23 for ease of grasping individual sheets 2.

There is a means, generally designated 30, which is engageable with the housing 20 for carrying such utility bag 10. Such carrying means 30 is preferably a flexible strap 32. A shoulder pad 34, preferably of thicker and wider material, may be slideably disposed along the strap 32. Furthermore, an adjustable buckle 36 may be provided for reversibly adjusting the length of such flexible strap 32. Alternatively to or in combination with the flexible strap 32, the utility bag 10 may include a handle 42.

Each of such flexible strap 32 and handle 42 may be permanently attached to the housing 20, or may be attached to the housing 20 in a removable manner by way of a snap-on clip 38 and a ring 40 as best shown in FIG. 2. Furthermore, the ring 40 may be utilized to attach the flexible strap 32 or the handle 42 in a permanent fashion.

To protect the contents disposed within the internal compartment 29, the utility bag includes means 50 for selectively closing and opening such internal compartment 29.

According to one embodiment of the invention, such closing and opening means 50 is a simple flap 50 hingedly connected to a top edge of one of the front panel 22 and the rear panel 24. Such flap 50 is movable into a generally horizontal position for closing the internal compartment 29 and movable into a generally vertical position for opening the internal compartment 29. In further reference to FIG. 2, the handle 42 may be attached to the flap 50.

According to another embodiment of the invention, such flap 50 includes a second flap 52 for covering a portion of the front panel 22 when the flap 50 is disposed in the generally horizontal position for closing the internal compartment 29.

The bag 10 may further includes a means, generally designated 60, for securing the closing and opening means 50 in a releasable manner to housing 20 when such closing and opening means 50 is positioned for closing the internal compartment 29.

In the presently preferred embodiment of the invention, such securing means 60 is a hook and loop fastener, or hook and snap fastener 60, having a first portion 62 secured to one of the front panel 22 and the second flap 52 and the second portion secured to an opposed one of the front panel 22 and the second flap 52. Alternatively, such securing means 60 may be a simple zipper 66 or a magnetic fastener 68.

It will be appreciated that the utility bag 10 is advantageous for conveniently carrying a plurality of generally thin promotional sheet materials 2 for distributing each sheet to at least one member of the public. Such promotional sheet materials 2 are generally 8.5 inches in width and 11 inches in height and are commonly used for promoting and advertising musical events, political events, sporting events, store sales, door-to-door solicitations and the like. Accordingly, each of the front panel 22 and the rear panel 24 will be about 9.0 inches in width and about 12.00 inches in height. Preferably, the width of each side panel 26 is about 2.0 inches.

At least one vertical divider 48 may be mounted within the internal compartment 29 of the housing 20 for carrying promotional sheet materials 2 having different content.

When it is desirable to carry and distribute a second plurality of generally thin promotional sheet materials 4, such as cards measuring about 4.0 inches in width and about 6.0 inches in height, of a different size, the bag 10 is adapted with an external pocket 70 attached to the front panel 22 and formed according to the construction of the housing 20. The pocket 70 may be provided with a flap 72 for selectively closing and opening the pocket 70 and may be further provided with any one of the fastening means 60, described supra, for securing the flap 72 to the external pocket 70 when the flap 72 is in a position for closing the internal compartment of the pocket 70.

It will be understood by those skilled in the relevant art that there is a need to carry and distribute a business card 8 in combination with the sheets 2 and 4. Accordingly, the bag 10 is provided with a second external pocket 74 sized to receive a plurality of business cards 8. Such pocket 74 may be formed on an exterior surface of one of the housing 20 and the external pocket 70.

Furthermore, when there is a need to conveniently carry a writing instrument, for example a pen 6, the bag 10 may be provided with an elongated third external pocket 76, best shown in FIG. 1, or a simple loop 78, best shown in FIG. 2. Additionally, the rear panel 24 may be formed from at least a semi-rigid material for use as a writing surface. In general, a material of bag 10 may be one of leather, soft plastic, fabric and various combinations thereof.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. In combination with plurality of generally thin promotional sheet materials a utility bag for carrying and distributing said promotional sheet materials, said utility bag consisting of:

(a) a housing having a generally rectangular parallelepiped shape and including, in combination, a front panel, a rear panel, a pair of sides panels and a bottom panel, said combination forming an internal compartment open at a top end of said housing, each of said front and rear panels having a width of about nine inches and height of about twelve inches, each of said side panels having a width of about two inches, whereby said internal compartment is sized to receive said plurality of generally thin promotional sheet materials;

(b) an elongated cutout formed in a top edge of said front panel of said housing for facilitating grasping of an individual generally thin promotional sheet, wherein a longer edge of said elongated notch is disposed generally parallel to said top edge of said front panel;

(c) a first member having a first longitudinal edge thereof hingeably connected to a top edge of said rear panel of said housing, said first member movable into a generally horizontal position for closing said internal compartment and movable into a generally vertical position for opening said internal compartment, said first longitudinal edge having a length thereof being substantially equal to a length of said top edge of said rear panel;

(d) a second member having one longitudinal edge thereof connected to an opposed longitudinal edge of said first member, said second member covering a portion of said front panel when said first member is disposed in said generally horizontal position;

(e) a first hook and loop fastener releaseably securing said second member to said front panel of said housing;

(f) an elongated flexible strap;

(g) a pair of snap-on clips, each of said pair of snap-on clips releaseably attaching one end of said elongated flexible strap to a loop attached to an exterior surface of a respective side panel of said housing;

(h) a shoulder pad slideably disposed along said elongated flexible strap;

(i) a first external pocket disposed on an exterior surface of said front panel of said housing and having each of a generally rectangular parallelepiped shape and an open top end aligned in a direction of said open top end of said housing, said first external pocket sized to carry cards having a width of about four inches and having a height of about six inches;

(j) a flap having a first portion movable for selectively closing and opening said open end of said first external pocket and a second portion covering a portion of an exterior front surface of a front wall of said first external pocket of when said first portion is disposed for covering said open top end of said first external pocket, wherein a length of each of said first and second portions is substantially equal to a length of said open top end of said first external pocket;

(k) a second hook and loop fastener releaseably securing a second portion of said flap to said exterior front surface of a front wall of said first external pocket;

(l) a second external pocket disposed on said exterior surface of said front wall of said first external pocket below a bottom edge of said second portion of said flap disposed in a position for closing said open end of said first external pocket, said third external pocket sized to receive a plurality of business cards therewithin; and (m) a third external pocket disposed on said exterior surface of said front panel of said housing adjacent to one side of said second external pocket, said third external pocket having each of an elongated shape and an open end aligned in a direction of said open top end of said housing, said third external pocket sized for carrying a writing implement therein.

* * * * *